United States Patent [19]

Wood

[11] Patent Number: 4,568,253

[45] Date of Patent: Feb. 4, 1986

[54] HORIZONTAL SHAFT OIL PUMP

[75] Inventor: Mark W. Wood, Britton, Mich.

[73] Assignee: Tecumseh Products Company, Tecumseh, Mich.

[21] Appl. No.: 756,921

[22] Filed: Jul. 18, 1985

Related U.S. Application Data

[63] Continuation of Ser. No. 556,084, Nov. 29, 1983, abandoned.

[51] Int. Cl.[4] ..... F04B 39/02; F01C 21/04; F04D 1/04

[52] U.S. Cl. ..... 417/372; 417/410; 417/902; 418/88; 418/94; 415/74; 184/6.16

[58] Field of Search ..... 417/372, 366, 410, 368, 417/902; 418/94, 88; 184/6.16, 26, 31; 415/74, 73, 72

[56] References Cited

U.S. PATENT DOCUMENTS

| | | | |
|---|---|---|---|
| 1,508,085 | 9/1924 | Cooper | 384/404 |
| 2,043,215 | 6/1936 | Smith et al. . | |
| 2,056,646 | 10/1936 | Conrad et al. | 417/372 |
| 2,226,622 | 12/1940 | Lignian . | |
| 2,361,815 | 10/1944 | Bixler | 417/372 |
| 2,435,110 | 1/1948 | Wagner | 415/73 |
| 2,457,221 | 12/1948 | Girard | 418/88 |
| 2,485,417 | 10/1949 | Steenstrup | 417/372 |
| 2,504,748 | 4/1950 | Steenstrup | 184/6.16 |
| 2,596,640 | 5/1952 | Berry | 418/88 |
| 2,721,026 | 10/1955 | Dills | 418/88 |
| 2,928,588 | 3/1960 | Sudmeier | 418/88 |
| 2,957,423 | 10/1960 | Audemar | 415/74 |
| 3,277,528 | 10/1966 | Nikiforov | 415/74 |
| 3,630,316 | 12/1971 | Sillano | 184/6.16 |

FOREIGN PATENT DOCUMENTS

| | | | |
|---|---|---|---|
| 713379 | 10/1931 | France | 417/372 |
| 7121195 | 6/1983 | Taiwan . | |

*Primary Examiner*—Cornelius J. Husar
*Assistant Examiner*—Peter M. Cuomo
*Attorney, Agent, or Firm*—Albert L. Jeffers; Anthony Niewyk

[57] ABSTRACT

A horizontal shaft oil pump is provided for use in a compressor comprising an outer housing having an inlet, an outlet, an oil sump, and a crankcase mounted therein. The crankcase has a generally vertically disposed passageway therein in communication with the oil sump, and a crankshaft is horizontally rotatably received in a bore in the crankcase. A reduced diameter portion of the crankshaft forms between the crankshaft and crankcase an annular chamber in communication with the passageway, and a pair of oppositely angularly disposed helical grooves are disposed in the crankshaft on opposite sides of and in communication with the annular chamber. Upon rotation of the crankshaft, a low pressure area is developed in the annular chamber causing lubricant to be drawn upwardly through the crankcase passageway and into the annular chamber. The rotating helical grooves deliver lubricant from the annular chamber to opposite end portions of the crankshaft for lubricating bearings and other moving parts.

8 Claims, 7 Drawing Figures

HORIZONTAL SHAFT OIL PUMP

This is a continuation of application Ser. No. 556,084, filed Nov. 29, 1983 abandoned.

BACKGROUND OF THE INVENTION

This invention pertains to an oil pump, and more particularly to an oil pump for use in a horizontal rotary compressor.

In some compressors, the crankshaft is vertically disposed in the compressor housing and has its lower end portion submerged in an oil sump. A helical groove is provided in the crankshaft, and upon rotation of the crankshaft by the motor, oil is delivered upwardly through the groove along the crankshaft for lubricating bearings and other moving parts. Generally, some type of impeller means is also provided at the lower end of the crankshaft to assist in urging oil upwardly through the helical groove.

In contrast to the above compressors wherein oil is delivered upwardly by a helical groove in the vertically mounted crankshaft, the crankshaft in a horizontal piston or rotary compressor cannot directly elevate the oil upwardly through a helical groove in the crankshaft. This has posed numerous problems in properly lubricating bearings and other moving parts in a horizontally disposed compressor. The fact that such horizontal compressors are presently in use indicates that some means have been provided in the prior art to deliver lubricant to a rotating horizontal crankshaft, however, problems continue to exist in adequately lubricating bearings and moving parts, as well as an inability to adequately self-prime the oil pump during start-up.

One earlier method for delivering lubricant upwardly to a rotating horizontal crankshaft uses a disc or plate attached to the crankshaft to rotate therewith and which has its lower portion disposed in the oil sump. A circular groove is provided in the flat surfaces of the disc, and upon rotation of the crankshaft, the disc rotates through the oil sump and carries lubricant in the grooves upwardly to a cavity or chamber adjacent the crankshaft. The lubricant is then delivered from the chamber by means of a series of passages to the crankshaft for lubricating bearings. Several drawbacks exist with this type of oil pump, one of the drawbacks being the inability to deliver a desired amount of lubricant to the crankshaft and associated bearings. Other drawbacks include additional expense in materials and labor in providing the grooved disc and a chamber in the crankcase with oil passages leading to the crankshaft and bearings.

Another type of oil pump for use with horizontal motor-compressor units utilizes a wick device disposed in the oil sump and in contact along several axial points of the crankshaft. The wick device delivers oil upwardly from the oil sump and through the wick to the crankshaft for further delivery along the crankshaft and bearings. An obvious drawback with this type of oiling device is that the wick may shrink down away from the crankshaft during prolonged use, thereby preventing proper lubrication of the crankshaft and bearings. Moreover, small pieces of the wick may eventually break off and clog oil passages or lodge between moving parts preventing proper movement.

In yet another type of horizontal compressor, a portion of the crankcase is submerged in the oil sump and has a passageway leading from the oil sump upwardly to a chamber provided between an eccentric reduced portion of the crankshaft and crankcase. Rotation of the crankshaft causes oil to be drawn upwardly through the crankcase passageway into the chamber and through an axially extending passage in the crankshaft. One of the problems associated with this particular type of oil pump is that the axially extending passage in communication with the chamber does not fully utilize the centrifugal force of the rotating crankshaft to efficiently deliver desired amounts of lubrication along the crankshaft for lubricating bearings.

In still another type of oil pump system for a rotating horizontal shaft, the center portion of the shaft is enlarged and tapers radially inwardly toward the remote ends. A pair of oppositely angularly disposed helical grooves are provided on the respective tapering surfaces of the enlarged center portion and have their axially outermost ends in communication with an oil supply. Upon rotation of the shaft and helical grooves therein, oil is delivered axially inwardly along the grooves to the center of the shaft for lubrication thereof. One of the undesired features with this type of oil pump is that the oil supply is required to be disposed at the same height as the ends of the rotating horizontal shaft. In virtually all horizontal rotary compressors, the crankshaft is disposed above the surface of the oil sump in the compressor housing.

In view of the above, it is quite clear that a need still exists for an oil pump in a horizontal motor-compressor unit that efficiently delivers lubricant upwardly to the crankshaft and horizontally along its length for proper lubrication of bearings and other moving parts, and which has a self-priming feature.

SUMMARY OF THE INVENTION

The horizontal shaft oil pump of the present invention eliminates the use of any type of disc or plate or wicking device for delivering lubricant upwardly to the crankshaft, and in place thereof provides a generally vertically disposed passageway in a portion of the crankcase disposed in the oil sump, the passageway communicating with the oil sump and leading upwardly to the crankshaft. A portion of the crankshaft is reduced in diameter so as to form between the crankshaft and the crankcase an annular chamber in communication with the crankcase passageway. upon rotation of the crankshaft, a low pressure area is developed in the annular chamber to draw lubricant from the oil sump upwardly through the crankcase passageway to the annular chamber.

The horizontal shaft oil pump of the present invention overcomes the general inability of many of the prior art oil pumps to efficiently supply a requisite amount of lubricant along the horizontal crankshaft for lubricating bearings and moving parts. This inability is overcome by providing a pair of oppositely oriented helical grooves on opposite sides of the annular chamber and which form between the crankshaft and crankcase a pair of oppositely oriented helical passages in communication with and leading away from the annular chamber. The helical passages are oppositely disposed to deliver oil in opposite directions from the annular chamber. Upon rotation of the horizontal crankshaft, the low pressure area created in the annular chamber draws lubricant from the oil sump upwardly through the crankcase passageway into the annular chamber. Lubricant is then delivered by the respective helical passages along the crankshaft for lubricating bearings and other moving parts.

The dimensions of each helical groove are such as to provide adequate oil flow for sufficient lubrication of bearings and to enable self-priming of the pump upon start-up.

In one form of the invention there is provided a compressor comprising a housing having an inlet, outlet, and an oil sump in the bottom thereof. A motor-compressor unit is mounted in the housing and includes a crankcase with a generally vertically disposed passageway in communication with the oil sump, a rotatable crankshaft, and means for compressing refrigerant. The crankshaft is generally horizontally disposed and rotatably received in the crankcase, and has a reduced diameter portion forming between the crankshaft and crankcase an annular chamber in communication with the crankcase passageway. The crankshaft further includes a helical groove forming between the crankshaft and crankcase a helical passage between the annular chamber and compressing means. Upon rotation of the crankshaft, a low pressure area is created in the annular chamber to draw lubricant upwardly through the crankcase passageway and into the annular chamber, from which oil is delivered by the helical passage axially along the crankshaft for lubricating the crankshaft bearings.

It is an object of the present invention to provide an improved horizontal shaft oil pump that efficiently delivers a desired amount of lubricant upwardly from an oil sump and horizontally along the crankshaft for lubricating bearings and other moving parts.

Another object of the present invention is to provide an improved horizontal shaft oil pump that is self-priming.

Yet another object of the present invention is to provide an improved horizontal shaft oil pump that is inexpensive to mânufacture and easily assembled.

Further objects of the present invention will appear as a description precedes.

BRIEF DESCRIPTION OF THE DRAWINGS

The above mentioned and other features and objects of this invention and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
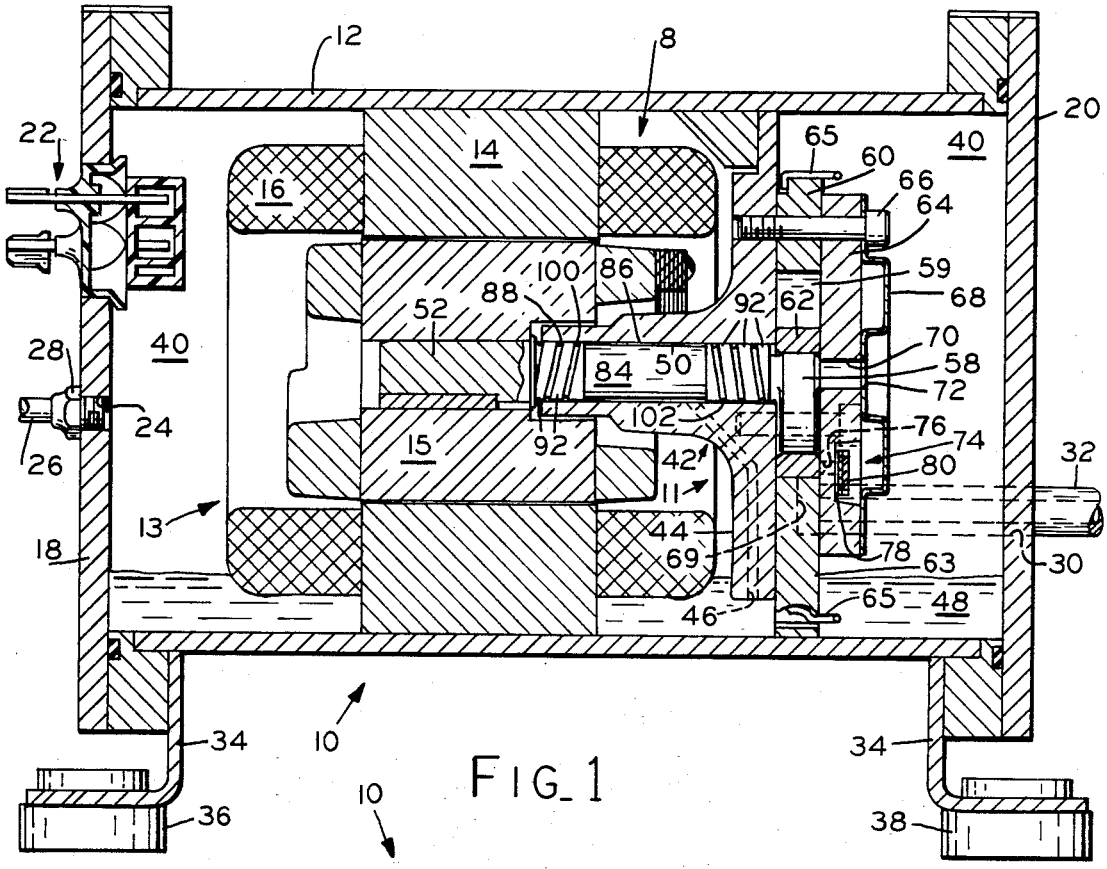
FIG. 1 is a longitudinal cross-sectional view of a preferred embodiment of the present invention.
Figure 2:
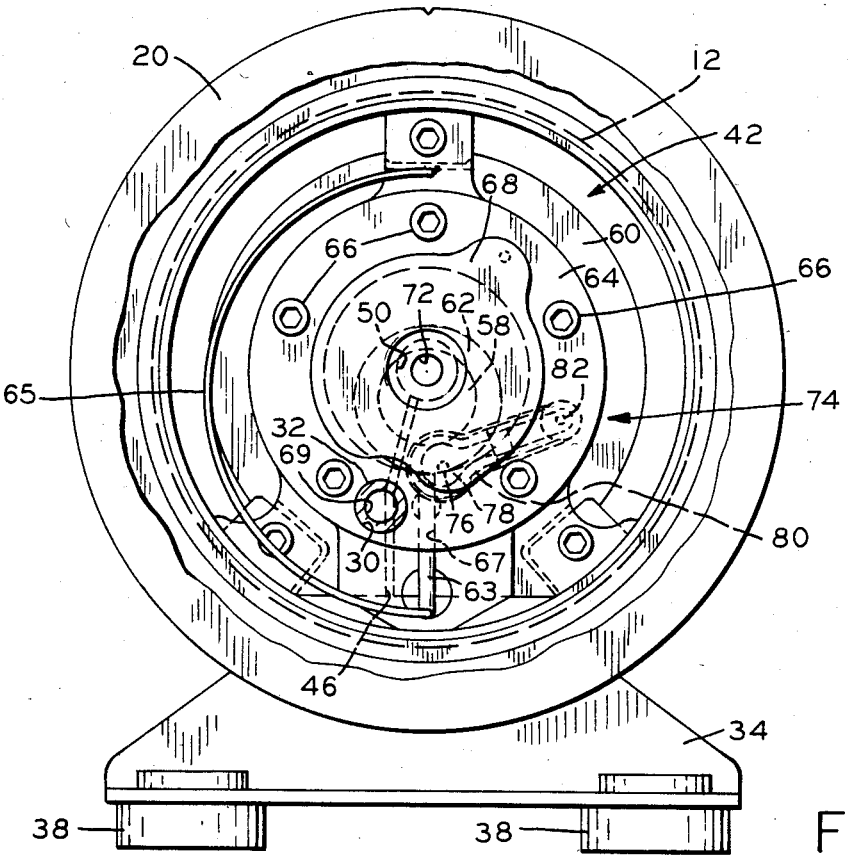
FIG. 2 is a partially broken-away end elevational view of the embodiment in FIG. 1.

Referring to FIGS. 1 and 2, a rotary compressor is indicated at 10 incorporating horizontal shaft oil pump 11 of the present invention. Although the present invention will be described in terms of rotary compressor 10, horizontal shaft oil pump 11 of can also be incorporated with other types of compressors requiring lubrication of rotating horizontal shafts.

The motor-compressor unit 8 of rotary compressor 10 comprises motor 13 having rotor 15 and stator 14 with windings 16, and cylindrical housing 12 shrunk down on stator 14. The opposite ends of housing 12 are closed by end plates 18, 20 welded thereto. End plate 18 includes terminal pin assembly 22 and discharge outlet 24 having discharge tube 26 connected thereto by connector 28. End plate 20 includes opening 30 through which is received suction inlet tube 32 indicated in dashed lines. A pair of mounting brackets 34, 36 are welded to the opposite ends of housing 12, and each includes a pair of support members, such as resilient grommets 36, 38.

Mounted within interior 40 of housing 12 is crankcase 42 including main bearing block 44 having oil passageway 46 generally vertically disposed therein. Housing 12 includes oil sump 48, and the lower portion of main bearing block 44 is submerged therein to provide communication between oil passageway 46 and horizontally disposed bore 50 in crankcase 42. For purposes of the present application, the term "vertically disposed" as it applies to passageway 46 is to be construed broadly and means that oil must flow upwardly therein from sump 48 against the force of gravity.

Crankshaft 52 is horizontally rotatably received in bore 50, and rotor 15 is shrunk down on portion 54 of crankshaft 52 to rotate crankshaft 52 upon application of electrical current to motor 13 through terminal pin assembly 22.

The opposite end portion of crankshaft 52 includes eccentric 58 having slot 59 and is received in cylinder 60, which is connected to main bearing block 44 by screws 66. Roller 62 is rotatably received about eccentric 58 in cylinder 60, and valve plate or back plate 64 is attached to cylinder 60 by means of screws 66. Discharge muffler 68 is attached to back plate 64 by screws 66, and back plate 64 includes hole 70 in axial alignment with crankshaft 52 and opening 72 in muffler 68. Vane 63 is slidably received in slot 67 in cylinder 60 and is biased against roller 62 by C-shaped spring 65, which is secured to cylinder 60. Cylinder 60 has inlet 69 with which suction inlet tube 32 communicates.

A valve assembly 74 permits compressed refrigerant to flow from cylinder 60 through back plate 64 and into discharge muffler 68. Valve assembly 74 includes opening 76 in back plate 64 which communicates between cylinder 59 and muffler 68. A leaf valve 78 is secured in place over opening 76 by valve retainer 80 and screw 82 (FIG. 2) received through valve retainer 80, valve 78, and threadedly secured in back plate 64.

Referring now to FIGS. 1, 3–6, crankshaft 52 has a reduced diameter center portion 84 which forms annular chamber 86 between crankshaft 52 and crankcase 42, annular chamber 86 communicating with oil passageway 46. Disposed in crankshaft 52 are a pair of helical grooves 88, 90 on opposite sides of and in communication with annular chamber 86.

Figure 3:
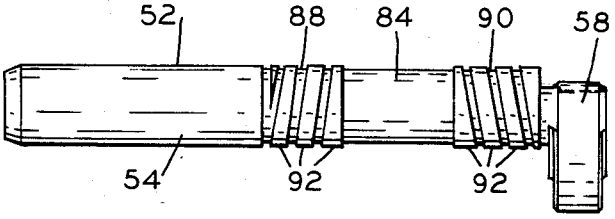
FIG. 3 is an elevational view of the crankshaft in the embodiment of FIG. 1.
Figure 6:
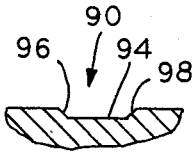
FIG. 6 is a partially broken-away cross-sectional view of a helical groove in the crankshaft of FIG. 3.
Figure 4:
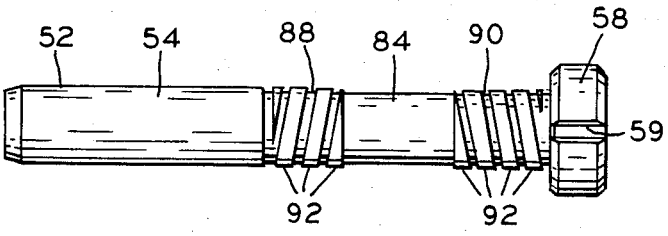
FIG. 4 is a top plan view of the crankshaft of FIG. 3.
Figure 5:
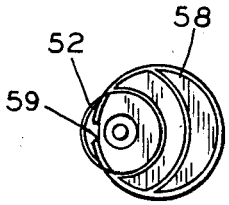
FIG. 5 is an end elevational view of the crankshaft in FIG. 4.

Referring particularly to FIGS. 3 and 4, it can be seen that grooves 88 and 90 are oppositely oriented in crankshaft 52 to deliver lubricant from annular chamber 86 in opposite directions along crankshaft 52. The radial dimension or depth and the axial dimension or length of each groove 88, 90 is predetermined as a function of several variables, among which are the diameter and length of the crankshaft, the vertical height of the crankshaft above the oil sump, and the like. Grooves 88, 90 are machined in crankshaft 52 to provide sufficient bearing surface between ridges 92 and the inner surface of crankcase bore 50, while at the same time efficiently supplying a desired amount of lubricant along crankshaft 52. In the disclosed embodiment, each groove 88, 90 has a bottom surface 94 with upwardly extending sides 96, 98 which diverge radially outwardly from bottom surface 94 to ridges 92 for ease of machining.

Given in the following are dimensions of a typical working embodiment of crankshaft 52 in the present invention, and are exemplary only and do not limit the scope of the invention:

| | |
|---|---|
| Compressor horsepower | ¼ |
| Crankcase bore ID | .5014–.5017" |
| Crankshaft OD | .5008–.5011" |
| Crankshaft axial length excluding eccentric 58 | 3.380–3.385" |
| Reduced diameter center portion 84 OD | .451–.461" |
| Groove radial depth | .005–.007" |
| Bottom surface 94 axial width | .035–.045" |
| Angular inclination of sides 96, 98 | 43°–47° |

Grooves 88, 90 are machined in crankshaft 52 at four threads per inch, and as illustrated in FIG. 1, form between crankshaft 52 and crankcase 44 helical passages 100,102, respectively, in communication with annular chamber 86. Passage 102 also communicates with slot 59 in eccentric 58 (FIG. 4).

In operation, electrical current is supplied to terminal pin assembly 22 to rotate rotor 15 and crankshaft 52, and refrigerant is supplied through suction inlet tube 32 and inlet 69 into cylinder 59. As crankshaft 52 rotates, eccentric 58 rotates roller 62 in cylinder 60 to compress the supplied refrigerant. Compressed refrigerant is discharged through valve assembly 74 into muffler 68, and then through an opening (not shown) in muffler 68 into the interior 40 of housing 12. The compressed refrigerant passes over motor 13 to cool motor 13 and is then discharged through outlet 24 into discharge tube 26.

Figure 7:
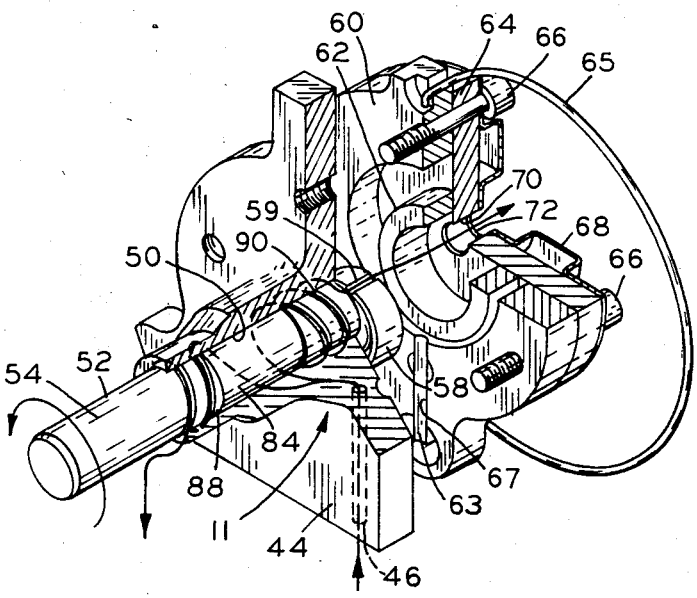
FIG. 7 is a partially broken-away exploded view of the embodiment in FIG. 1 illustrating the flow of lubricant.

Referring to FIGS. 1, 4, and 7, lubrication is provided as soon as crankshaft 52 is rotated. The rotation of crankshaft 52 creates a partial vacuum or low pressure area in annular chamber 86 which draws lubricant upwardly from oil sump 48 through oil passageway 46 into chamber 86. From annular chamber 86, lubricant is delivered in opposite directions by helical passages 100, 102. Lubricant is discharged from helical passage 100 on to rotor 15, which will throw the lubricant outwardly against the inner surface of housing 12 for cooling and return to oil sump 48.

Lubricant delivered by helical passage 102 lubricates bore 50 of crankcase 42, and exits passageway 102 through slot 59 in eccentric 58. Lubricant delivered to slot 59 lubricates the mutually engaging surfaces of eccentric 58 and roller 62. From slot 59, lubricant is then delivered through hole 70 in back plate 64 and opening 72 in discharge muffler 68 for return to oil sump 48.

If desired, an outboard bearing (not shown) may be provided with eccentric 58 to rotate within bore 70 in back plate 64. Any such outboard bearing may include an oil passage in communication with slot 59 in eccentric 58 to deliver lubricant through the outboard bearing and to oil sump 48.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. A horizontal rotary compressor, comprising:

a hermetically sealed housing having an inlet and an outlet therein, and an oil sump in the bottom thereof, and a rotary-compressor unit mounted in said housing and including a crankcase having a bore generally horizontally disposed therein and a generally vertically disposed oil passageway in communication with said oil sump, a crankshaft rotatably received in said bore, and a motor including a rotor for rotating said crankshaft, said crankshaft having a first end secured to the rotor of said motor and a second end secured to a rotary refrigerant compressing means for compressing refrigerant, said crankshaft being generally horizontally disposed and having a reduced diameter portion forming in said bore an annular chamber having a first and second end in communication with said oil passageway, said crankshaft including a first helical groove forming between said crankshaft and said crankcase a first helical passage which extends between said first end of said annular chamber and said crankshaft first end, said crankshaft further including a second helical groove forming between said crankshaft and said crankcase a second helical passage which extends between said second end of said annular chamber and said crankshaft second end, whereby a low pressure area is developed in said annular chamber when said motor rotates said crankshaft to draw lubricant from said oil sump upwardly through said passageway and into said annular chamber, said first and second helical passages delivering lubricant from said annular chamber in respective opposing directions along said crankshaft to lubricate the bore and said compressing means.

2. The compressor of claim 1 wherein said compressing means comprises an eccentric with a roller member rotatably received thereabout, said eccentric including an axially extending slot in communication with said second helical passage to deliver lubricant between said eccentric and said roller member.

3. The compressor of claim 1 wherein the radial dimension of said first and second grooves is less than the axial dimension of said grooves, said dimension being predetermined so as to provide sufficient bearing surface between said crankcase and said crankshaft and sufficient oil for self-priming.

4. A hermetic compressor comprising:

a housing having an inlet, an outlet, and an oil sump in the bottom thereof, a motor-compressor unit mounted in said housing and including a crankcase, a generally vertically disposed oil passageway in communication with said oil sump, a rotatable crankshaft, a motor for rotatingly driving said crankshaft, a cylinder, and means connected to said crankshaft for compressing refrigerant, said crankshaft being generally horizontally disposed and rotatably received in crankshaft bearings in said crankcase, and having a reduced diameter portion forming between said crankshaft and said crankcase an annular chamber in communication with said oil passageway, said crankshaft including first and second helical grooves forming between said crankshaft and said crankcase first and second helical passages extending respectively from said annular chamber, toward said motor and said compressing means, whereby a low pressure area is created in said annular chamber when said crankshaft is rotated to thereby draw lubricant upwardly through said oil passageway and into said annular chamber, said helical passages in said rotating crankshaft delivering lubricant from said annular chamber in opposite directions along said crankshaft to said crankshaft bearings and the refrigerant compressing means.

5. The compressor of claim 4 wherein the facing opposite sides of each said first and second grooves diverge radially outwardly.

6. The compressor of claim 5 wherein each of said groove has a radial dimension less than its axial dimension.

7. The compressor of claim 4 wherein said compressing means is a rotary compressing means comprising an eccentric with an annularly-shaped roller member rotatably received thereabout, said eccentric having an axially extending slot in its radially outer surface in communication with one of said first and second helical passages to deliver lubricant between said eccentric and said roller member.

8. The compressor of claim 7 wherein the radial dimensions of said grooves are less than the axial dimensions of said grooves, and the facing opposite sides of each said groove diverge radially outwardly from the bottom of their respective said groove.

* * * * *